US008638288B2

(12) United States Patent
Taylor et al.

(10) Patent No.: US 8,638,288 B2
(45) Date of Patent: Jan. 28, 2014

(54) RGB LED BACKLIGHT COLOR CONTROL USING ADJUSTABLE DRIVING CURRENT

(75) Inventors: Erin L. Taylor, Pflugerville, TX (US); John Matthew Knadler, IV, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 1004 days.

(21) Appl. No.: 12/324,149

(22) Filed: Nov. 26, 2008

(65) Prior Publication Data

US 2010/0128064 A1 May 27, 2010

(51) Int. Cl.
*G09G 3/36* (2006.01)

(52) U.S. Cl.
USPC ..... 345/102; 345/82

(58) Field of Classification Search
USPC ..... 345/102
See application file for complete search history.

(56) References Cited

U.S. PATENT DOCUMENTS

| | | | | |
|---|---|---|---|---|
| 6,753,661 | B2 | 6/2004 | Muthu et al. | |
| 6,888,529 | B2 | 5/2005 | Bruning et al. | |
| 7,002,546 | B1 * | 2/2006 | Stuppi et al. | 345/102 |
| 2002/0101397 | A1 * | 8/2002 | Ohira et al. | 345/87 |
| 2006/0097978 | A1 * | 5/2006 | Ng et al. | 345/102 |
| 2006/0206734 | A1 * | 9/2006 | Hori | 713/300 |
| 2007/0115662 | A1 * | 5/2007 | Roberts et al. | 362/252 |
| 2007/0268236 | A1 | 11/2007 | Morrow | |

OTHER PUBLICATIONS

Future Electronics, Color Management Controller with Integrated Photo Sensor; Future Technology Magazine; 2 pages; http://www.future-mag.com/0610/061020.asp.

Avago Technologies; Method of Fast Brightness Change Using BRIGHT Register of ADJD-J823; Application Note 5398; 4 pages.

* cited by examiner

*Primary Examiner* — Kevin M Nguyen
*Assistant Examiner* — Cory Almeida
(74) *Attorney, Agent, or Firm* — Haynes and Boone, LLP

(57) ABSTRACT

A Red, Green, Blue Light Emitting Device (RGB LED) backlight color control system includes an RGB LED backlight comprising a red LED, a green LED, and a blue LED. A driving current regulator is coupled to each of the red LED, the green LED, and the blue LED. A backlight power control is coupled to each of the driving current regulators and operable to receive adjustment data and use the adjustment data to adjust the driving current supplied by at least one of the driving current regulators to at least one of the red LED, the green LED, and the blue LED. By adjusting the driving current supplied to the red LED, green LED, and/or the blue LED, color pallet points on a color triangle (associated with a display that uses the RGB LED backlight) are shifted to achieve the color desired by the user, avoiding the loss of color pallet points in the color triangle that occurs with conventional re-mapping techniques.

16 Claims, 7 Drawing Sheets

| COLOR OFFSET REGISTER - RED (0x04) | | | | | | | |
|---|---|---|---|---|---|---|---|
| REGISTER 0x04 - RED OFFSET | | | | | | | |
| BRT7<br>POLARITY | BRT6<br>BIT 6 (R/W) | BRT5<br>BIT 5 (R/W) | BRT4<br>BIT 4 (R/W) | BRT3<br>BIT 3 (R/W) | BRT2<br>BIT 2 (R/W) | BRT1<br>BIT 1 (R/W) | BRT0<br>BIT 0 (R/W) |
| **BIT FIELD DEFINITIONS** | | | | | | | |
| BRT[6, 5, 4, 3, 2, 1, 0] = 128 STEPS OF BRIGHTNESS LEVELS | | | | | | | |
| BRT[7] = POLARITY (0 = POSITIVE, 1 = NEGATIVE) | | | | | | | |

| COLOR OFFSET REGISTER - GREEN (0x05) | | | | | | | |
|---|---|---|---|---|---|---|---|
| REGISTER 0x04 - GREEN OFFSET | | | | | | | |
| BRT7<br>POLARITY | BRT6<br>BIT 6 (R/W) | BRT5<br>BIT 5 (R/W) | BRT4<br>BIT 4 (R/W) | BRT3<br>BIT 3 (R/W) | BRT2<br>BIT 2 (R/W) | BRT1<br>BIT 1 (R/W) | BRT0<br>BIT 0 (R/W) |
| **BIT FIELD DEFINITIONS** | | | | | | | |
| BRT[6, 5, 4, 3, 2, 1, 0] = 128 STEPS OF BRIGHTNESS LEVELS | | | | | | | |
| BRT[7] = POLARITY (0 = POSITIVE, 1 = NEGATIVE) | | | | | | | |

| COLOR OFFSET REGISTER - BLUE (0x06) | | | | | | | |
|---|---|---|---|---|---|---|---|
| REGISTER 0x04 - BLUE OFFSET | | | | | | | |
| BRT7<br>POLARITY | BRT6<br>BIT 6 (R/W) | BRT5<br>BIT 5 (R/W) | BRT4<br>BIT 4 (R/W) | BRT3<br>BIT 3 (R/W) | BRT2<br>BIT 2 (R/W) | BRT1<br>BIT 1 (R/W) | BRT0<br>BIT 0 (R/W) |
| **BIT FIELD DEFINITIONS** | | | | | | | |
| BRT[6, 5, 4, 3, 2, 1, 0] = 128 STEPS OF BRIGHTNESS LEVELS | | | | | | | |
| BRT[7] = POLARITY (0 = POSITIVE, 1 = NEGATIVE) | | | | | | | |

Fig. 3b

RGB LED BACKLIGHT COLOR CONTROL USING ADJUSTABLE DRIVING CURRENT

BACKGROUND

The present disclosure relates generally to information handling systems, and more particularly to controlling the color of a display of an information handling system.

As the value and use of information continues to increase, individuals and businesses seek additional ways to process and store information. One option is an information handling system (IHS). An IHS generally processes, compiles, stores, and/or communicates information or data for business, personal or other purposes. Because technology and information handling needs and requirements may vary between different applications, IHSs may also vary regarding what information is handled, how the information is handled, how much information is processed, stored, or communicated, and how quickly and efficiently the information may be processed, stored, or communicated. The variations in IHSs allow for IHSs to be general or configured for a specific user or specific use such as financial transaction processing, airline reservations, enterprise data storage, or global communications. In addition, IHSs may include a variety of hardware and software components that may be configured to process, store, and communicate information and may include one or more computer systems, data storage systems, and networking systems.

IHSs typically include a display coupled to the IHS in order to display information from the IHS. Conventional displays include backlights that are used to produce the image that is displayed on the display. Typically, these backlights have included a number of different devices such as, for example, Cold Cathode Fluorescent Lighting (CCFL) or White Light Emitting Devices (WLEDs). However, recently there has been a shift to the use of Red, Green, and Blue Light Emitting Devices (RGB LEDs) to provide the backlights, as RGB LED backlights maintain equivalent or lower power consumption relative to CCFL backlights when used in high color gamut displays, and provide a superior viewing experience by offering a high color gamut at over 90% as compared to 72% with a CCFL or 42% with a WLED. Furthermore, RGB LED backlights do not suffer from the lifetime issues of WLEDs and do not contain any toxic chemicals such as those that are found in CCFLs.

However, controlling the color of the display that uses RGB LED backlights raises a number of issues. Conventionally, an RGB LED backlit display is manufactured with fixed gamma voltages, color filter, and backlight, which creates a defined and fixed color pallet for the display. In order to control the color of the display after manufacture, a data manipulation technique is performed where display data is altered through the use of algorithms or look up tables to produce a re-mapping of data points on the color pallet to achieve a desired color for a given set of display data that would not otherwise be produced according to the fixed color pallet created during manufacture. Because the number of data points in the color pallet is fixed, this re-mapping of data points results in a reduced color pallet, thereby reducing the number of colors available to display.

Accordingly, it would be desirable to provide an improved display color control absent the disadvantages discussed above.

SUMMARY

According to one embodiment, an RGB LED backlight color control system includes an RGB LED backlight including a red LED, a green LED, and a blue LED, a driving current regulator coupled to each of the red LED, the green LED, and the blue LED, and a backlight power control coupled to each of the driving current regulators and operable to receive adjustment data and use the adjustment data to adjust the driving current supplied by at least one of the driving current regulators to at least one of the red LED, the green LED, and the blue LED.

BRIEF DESCRIPTION OF THE DRAWINGS

FIG. 3*b* is a chart illustrating an embodiment of a plurality of color offset registers used with the display color control system of FIG. 3*a*.

DETAILED DESCRIPTION

For purposes of this disclosure, an IHS may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an IHS may be a personal computer, a PDA, a consumer electronic device, a network server or storage device, a switch router or other network communication device, or any other suitable device and may vary in size, shape, performance, functionality, and price. The IHS may include memory, one or more processing resources such as a central processing unit (CPU) or hardware or software control logic. Additional components of the IHS may include one or more storage devices, one or more communications ports for communicating with external devices as well as various input and output (I/O) devices, such as a keyboard, a mouse, and a video display. The IHS may also include one or more buses operable to transmit communications between the various hardware components.

Figure 1:
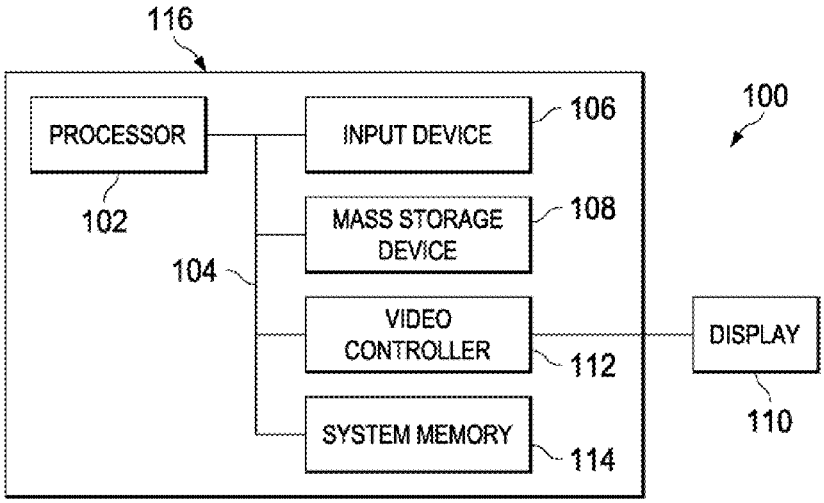
FIG. 1 is a schematic view illustrating an embodiment of an IHS.

In one embodiment, IHS 100, FIG. 1, includes a processor 102, which is connected to a bus 104. Bus 104 serves as a connection between processor 102 and other components of IHS 100. An input device 106 is coupled to processor 102 to provide input to processor 102. Examples of input devices may include keyboards, touchscreens, pointing devices such as mouses, trackballs, and trackpads, and/or a variety of other input devices known in the art. Programs and data are stored on a mass storage device 108, which is coupled to processor 102. Examples of mass storage devices may include hard discs, optical disks, magneto-optical discs, solid-state storage devices, and/or a variety other mass storage devices known in the art. IHS 100 further includes a display 110, which is coupled to processor 102 by a video controller 112. A system memory 114 is coupled to processor 102 to provide the processor with fast storage to facilitate execution of computer programs by processor 102. Examples of system memory may include random access memory (RAM) devices such as dynamic RAM (DRAM), synchronous DRAM (SDRAM), solid state memory devices, and/or a variety of other memory devices known in the art. In an embodiment, a chassis 116 houses some or all of the components of IHS 100. It should be understood that other buses and intermediate circuits can be deployed between the components described above and processor 102 to facilitate interconnection between the components and the processor 102.

Referring now to FIGS. 2*a*, 2*b*, 2*c* and 2*d*, a prior art system for controlling display color using RGB LED backlights is illustrated. A display such as, for example, the display 110, may be an liquid crystal display (LCD) that includes a cell 200 that may be an LCD cell, illustrated in FIG. 2*a*. In an embodiment, the display 110 includes a plurality of the cells 200. The cell 200 includes a backlight 202 that may include, for example, an RGB LED backlight. A shutter 204 is located adjacent the backlight 202 and includes a plurality of shutter members 204*a*, 204*b* and 204*c* that are operable control the amount of light from the backlight 202 that passes through the shutter 204. A plurality of color filters 206*a*, 206*b* and 206*c* are located adjacent the shutter members 204*a*, 204*b* and 204*c*, respectively, on the shutter 204 and are operable to filter white light that passes through the shutter 204 from the backlight 202 to create red, green, and blue light, respectively. A pixel 208 includes a plurality of pixel members 208*a*, 208*b* and 208*c* that are located adjacent the color filters 206*a*, 206*b* and 206*c*, respectively, and are operable to allow the filtered light (e.g., red light for the pixel member 208*a*, green light for the pixel member 208*b*, and blue light for the pixel member 208*c*) to be displayed by the display.

Figure 2A:
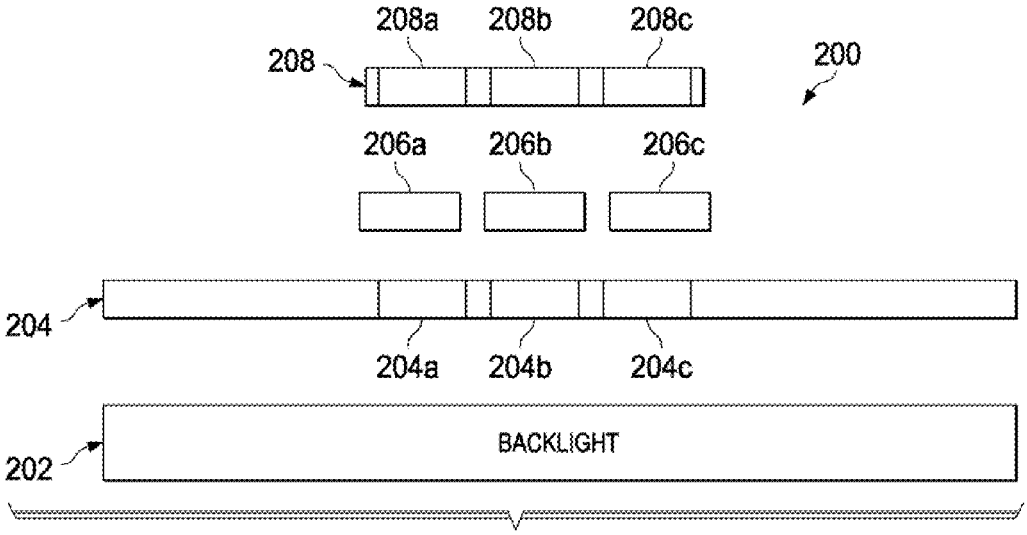
Fig. 2a (PRIOR ART)
FIG. 2*a* is a schematic view illustrating an embodiment of a cell.
Figure 2B:
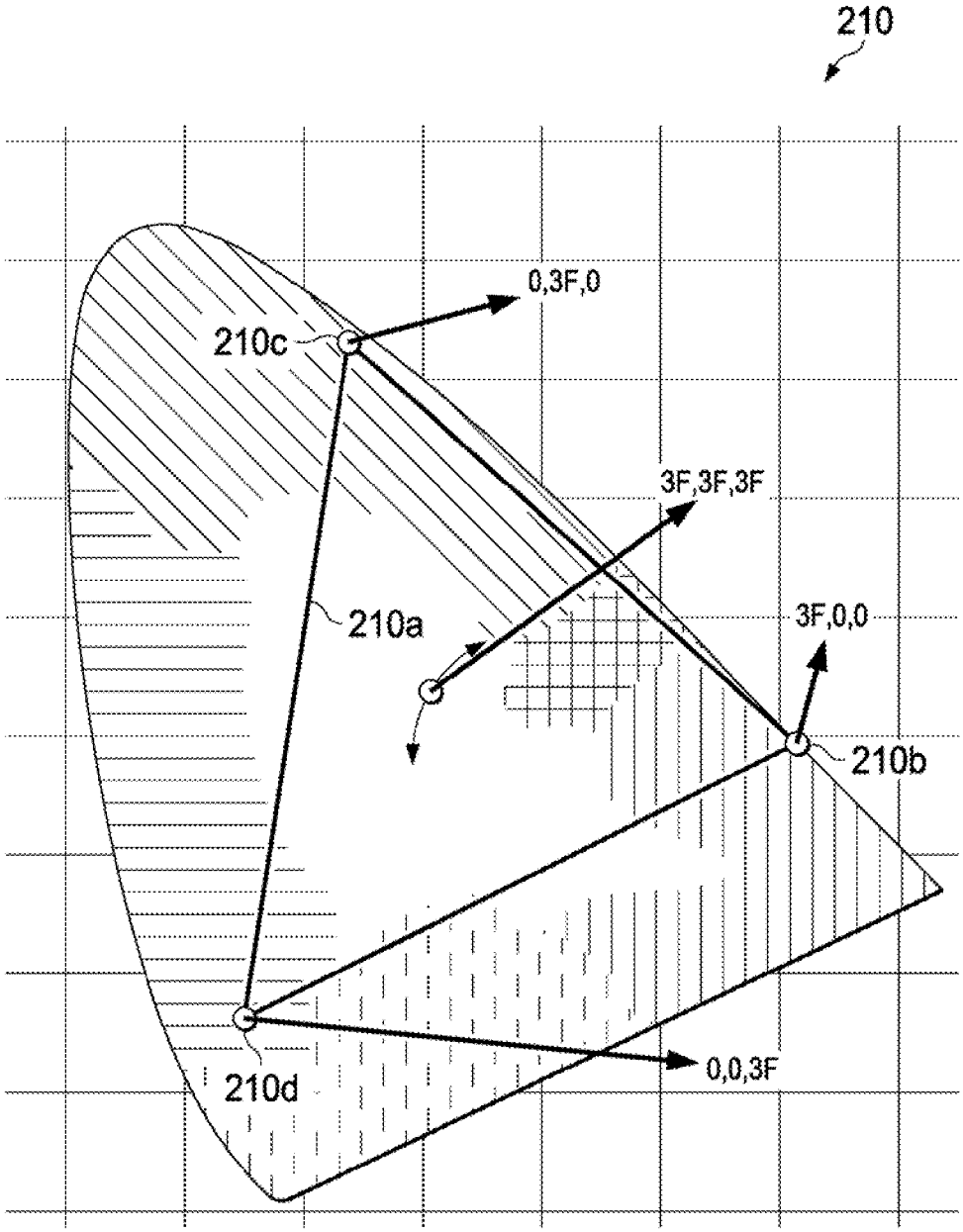
FIG. 2*b* is a graphical view illustrating an embodiment of a color pallet associated with the cell of FIG. 2*a*.
Figure 2C:
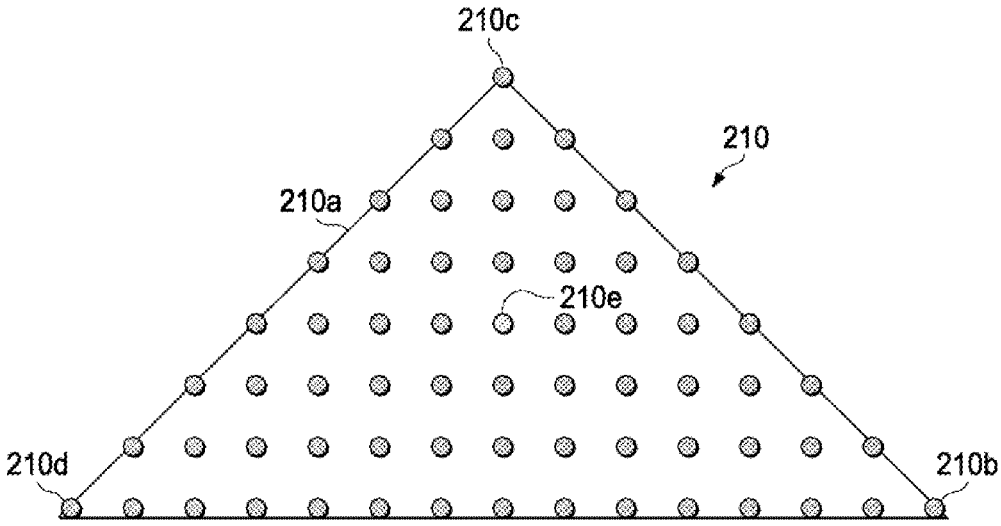
FIG. 2*c* is a schematic view illustrating an embodiment of a color triangle in the color pallet of FIG. 2*b*.

Conventionally, the display is manufactured with fixed gamma voltages, color filter, and backlight, creating a fixed color pallet 210 defined by a color triangle 210*a* that includes a red vertice 210*b*, a green vertice 210*c*, and a blue vertice 210*d*, illustrated in FIG. 2*b*. Once the fixed color pallet 210 is defined, only colors within the color triangle 210*a* may be produced. FIG. 2*c* illustrates a simplified color triangle having 64 color pallet points including a red color pallet point at vertice 210*b*, a green color pallet point at vertice 210*c*, a blue color pallet point at vertice 210*d*, a white color pallet point 210*e*, and a plurality of color pallet points that are combinations of red, green and blue. However, one of skill in the art will recognize that the example of FIG. 2*c* is merely for purposes of discussion and that many more data points may be used without departing from the scope of the present disclosure.

Figure 2D:
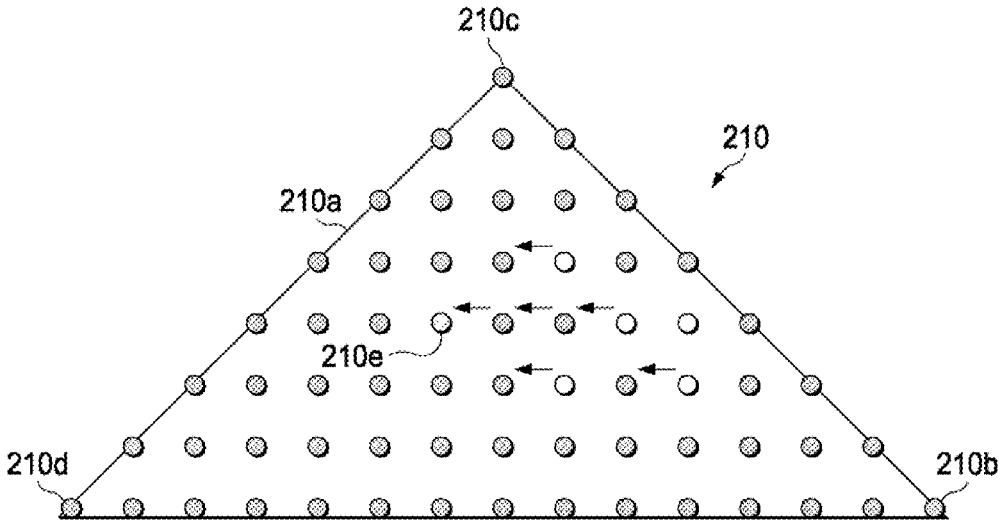
Fig. 2d (PRIOR ART)
FIG. 2*d* is a schematic view illustrating an embodiment of the conventional re-mapping of the color triangle of FIG. 2*c*.

Referring again to FIG. 2*a*, to produce a color on the display, the backlight 202 is activated to create a white light from the RGB LEDs, each of whose intensity is fixed during the manufacture of the display. That white light passes through the shutter 204 to the color filters 206*a*, 206*b* and 206*c*, creating red, green and blue light that may exit the pixel 208. By using display data to control the shutter members 204*a*, 204*b* and 204*c* and regulate how much of the white light from the backlight 202 passes through the shutter members 204*a*, 204*b* and 204*c* 204 to the color filters 206*a*, 206*b* and 206*c*, the amount of the red, green and blue light that is allowed to exit the pixel 208 is controlled, and hence the color produced by the pixel 208 may be controlled. As discussed above, the white point of the backlight 202 was set during manufacture of the display and may not be adjusted. This leads to a conventional method of controlling the colors of the display that involves a data manipulation technique. For example, a display may produce a maroon color corresponding to a color pallet point within the color triangle 210*a* when display data of 27, 03, 1B (h) is loaded. However, a user may desire that the display data of 27, 03, 1B (h) produce a maroon color with a more red tint that corresponds to a different color pallet point within the color triangle 210*a* than is produced according to the color palate fixed during manufacture. To achieve this, a look-up table or algorithm may be used that adds 6 (h) to the red value of the display data 27, 03, 1B (h), remapping that display data to 2F, 03, 1B (h) and creating a redder maroon color for that display data. However, because the number of color pallet points is fixed, the remapping of the display data reduces the overall number of color pallet points available. FIG. 2*d* illustrates the remapping of display data for 6 color pallet points that results in the reduction of the number of color pallet points in the color triangle 210*a* from 64 to 59, as the white color pallet points in FIG. 2*d* represent color pallet points for which the display data has been remapped and, hence, for which there no longer exists display data that will produces those color pallet points.

Figure 3A:
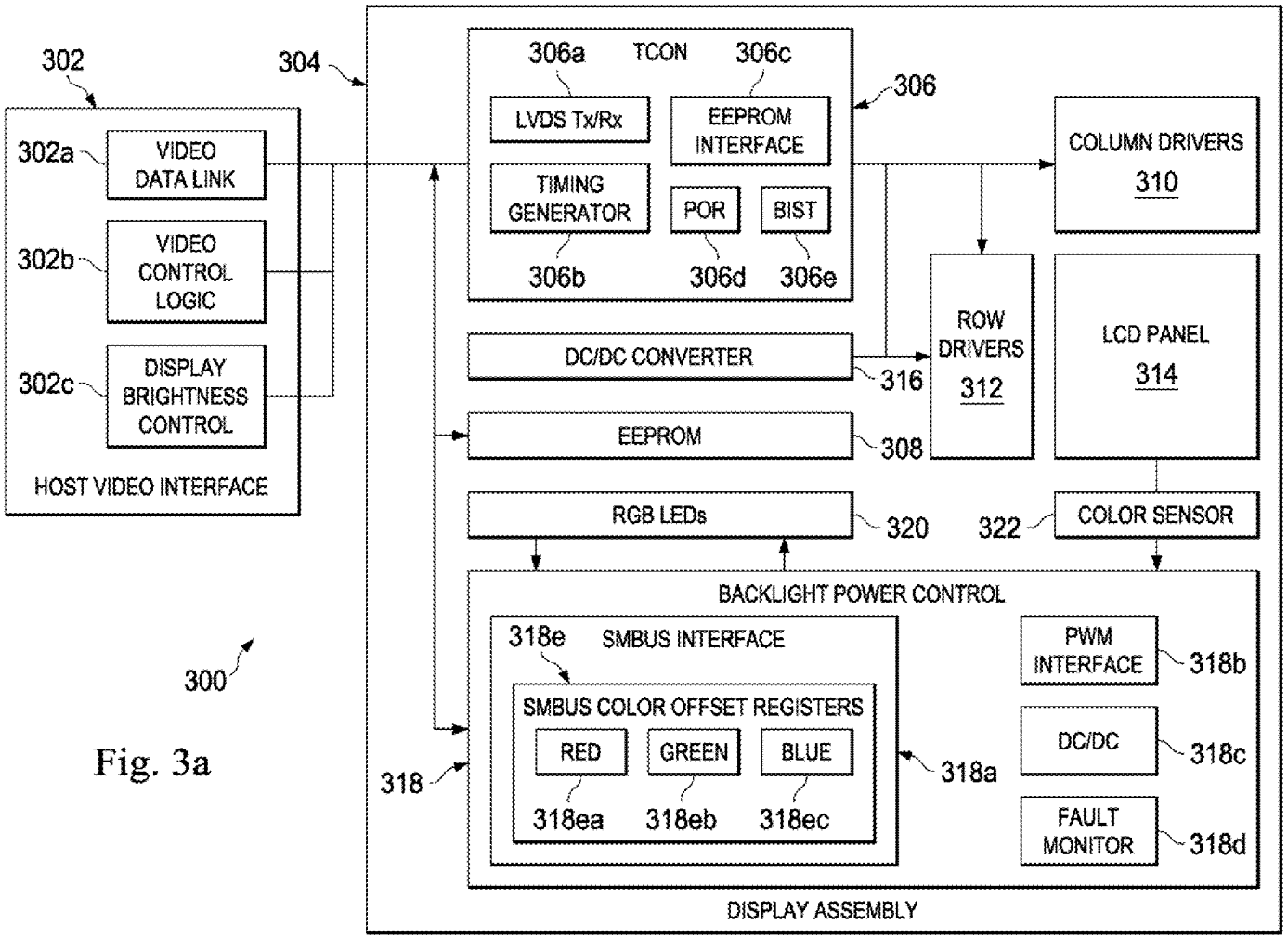
FIG. 3*a* is a schematic view illustrating an embodiment of a display color control system.

Referring now to FIG. 3*a*, a system 300 for controlling display color is illustrated. The system 300 may be included in the IHS 100, described above with reference to FIG. 1. The system 300 may include a plurality of the cells 200, illustrated in FIG. 2*a*. As illustrated in FIG. 3*a*, the system 300 includes a host video interface 302 for generating and transmitting video data and backlight commands. The host video interface 302 includes a video data link 302*a* for transmitting video data, a video control logic 302*b* for telling the display to turn on or off, communicating timing requirements, and a variety of other logic commands known in the art, and a display brightness control for communicating desired backlight brightness levels. The host video interface 302 (and with it the video data link 302*a*, video control logic 302*b*, and display brightness control 302*c*) is coupled to a display assembly 304 which, in the illustrated embodiment, is an LCD panel assembly. The display assembly 304 includes a timing controller (TCON) 306 that is coupled to the host video interface 302 and includes a low voltage differential signaling bus receiver and transmitter (LVDS Rx/Tx) 306*a*, a timing generator 306*b* for determining the correct timing sequences for sending signals to the LCD cell, an electronically erasable programmable read only memory (EEPROM) interface 306*c* for communicating between the TCON 306 and an EEPROM, a power-on reset circuit (POR) 306*d*, and a built-in self test (BIST) 306*e* that allows the LCD to drive itself with test screens without interaction from the IHS. An EEPROM 308 that contains fixed timing values for the display is coupled to the TCON 206. A plurality of column drivers 310 and row drivers 312 that include the drive integrated circuits and the thin film transistor cell for an LCD panel 314 are coupled to the TCON 306. A DC/DC converter 316 is coupled to the row drivers 310 and the column drivers 312 to provide the DC voltages needed by the LCD.

A backlight power control 318 that receives display color adjustment data from the IHS and creates the required power level and wave forms to drive an RGB LED backlight is coupled to the host video interface 302, the TCON 306, the EEPROM 308, and a plurality of RGB LEDs 320 that create the backlight. The backlight power control 318 includes a serial data communication bus interface such as, for example, the system management bus (SMBus) interface 318*a* that receives backlight control signals from the serial data communication bus (e.g., the SMBus) in the IHS. The SMBus interface 318*a* includes a plurality of SMBus color offset registers 318*e*. The plurality of SMBus color offset registers 318*e* include a red offset register 218*ea*, a green offset register 318*eb*, and a blue offset register 318*ec* that may be programmed by the IHS to offset the red, green and blue colors from the initially programmed values. An example of red, green and blue color offset registers according to an implementation of the present disclosure using the SMBus is illustrated in FIG. 3*b*. The backlight power control 318*a* also includes a pulse width modulation (PWM) interface 318*b* that may receive a pulse width modulated signal whose duty cycle may correspond to adjustment data from the IHS, a DC/DC 318*c* that converts power to create the required LED drive power, and a fault monitor 318*d* that monitors the backlight driving for faults such as over-voltage, over-current, open circuits, and a variety of other faults known in the art. A color sensor 322 is coupled between the LCD panel 314 and the backlight power control 318 to provide real-time optical feedback so that each RGB LED may adjusted to compensate for LED performance due to, for example, temperature sensitivity or aging, in order to maintain a fixed white point.

Figure 3C:
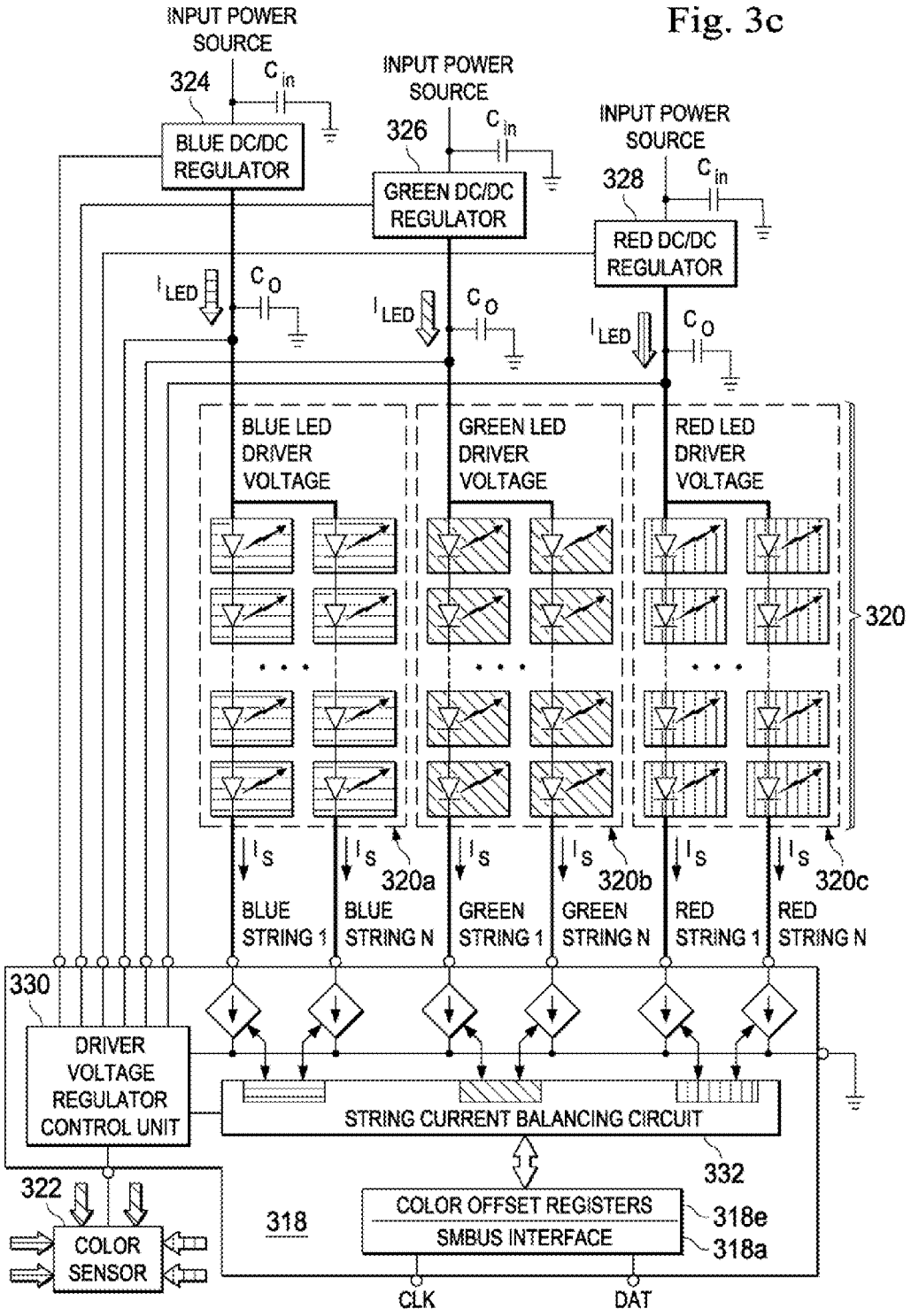
FIG. 3*c* is a schematic view illustrating an embodiment of a display color control system.

Referring now to FIG. 3*c*, a schematic view of the system 300 is provided that illustrates the backlight power control 318, the RGB LEDs 320, and the color sensor 322, while omitting some of the components illustrated in FIG. 3*a* and adding some components not illustrated in FIG. 3*a*. A blue DC/DC regulator 324 is coupled between a plurality of blue LEDs 320*a* and an input power source, a green DC/DC regulator 326 is coupled between a plurality of green LEDs 320*b* and an input power source, and red DC/DC regulator 328 is coupled between a plurality of red LEDs 320*c* and an input power source. Each of the blue DC/DC regulator 324, green DC/DC regulator 326, and red DC/DC regulator 328 is coupled to a driver voltage regulator control unit 330 located in the backlight power control 318. Each of the blue LEDs 320*a*, the green LEDs 320*b*, and the red LEDs 320*c* are coupled to a string current balancing circuit 332 that is located in the backlight power control 318 and coupled to the driver voltage regulator control unit 330, the SMBus interface 318*a*, and the SMBus color offset registers 318*e*.

Referring now to FIGS. 1, 3*a*, 3*b*, 4*a*, 4*b* and 4*c*, a method 400 for controlling display color is illustrated. The method 400 begins at block 402 where adjustment data is received. In an embodiment, the adjustment data is received from the IHS 100 by the backlight power control 318. In an embodiment, a user interface 402*a* may be provided to the user through the input device 106 (e.g., dials on the IHS chassis 116), through the display 110 (e.g., a graphical user interface (GUI)), and/or using a variety of other methods known in the art. The user interface 402*a* includes a red color balance 402*b* having a red color adjustor 402*ba*, a green color balance 402*c* having a green color adjustor 402*ca*, and a blue color balance 402*d* having a blue color adjustor 402*da*. The user may adjust the red color adjustor 402*ba*, the green color adjustor 402*c*, and/or the blue color adjustor 402*da* in order to control colors displayed on the display 110. For example, in the illustrated embodiment, the blue color adjustor 402*da* has been adjusted from a "zero point" to increase the amount of blue displayed on the display 110. The adjusting of the blue adjustor 402*da* is interpreted as adjustment data that corresponds to the desired adjustment that was indicated on the user interface 402*a*, and that adjustment data is sent by the IHS 100 to the backlight power control 318 through, for example, the SMBus. In another embodiment, the user of the IHS 100 may determine desired color settings for a specific application by, for example, using the user interface 402*a*. The user may then save the adjustment data that corresponds to those color settings in the application such that, when the application is used, the adjustment data is sent from the IHS 100 to the backlight power control 318 through, for example, the SMBus. In implementations where the adjustment data is communicated to the backlight power control 318*a* from the IHS 100 via the SMBus, the color settings may easily be associated with specific applications. For example, adjustment data corresponding to color settings for a word processing application or media viewer application may be saved and loaded each time that application is used. Thus, the color settings of the display may be dynamically changed according to, for example, the application being used on an IHS. While the adjustment data has been described as being sent from the IHS 100 to the backlight power control 318 through the SMBus, the present disclosure is not so limited, and one of skill in the art will recognize other technologies that may be utilized such as, for example, DisplayPort, Pulse Width Modulation, $I^2C$, and/or a variety of other technologies known in the art.

The method 400 then proceeds to block 404 where the average driving current(s) needed to control the color of the display are determined. The backlight power control 318 receives the adjustment data via an SMBus write operation to the color offset registers 318*e*. The receiving of the adjustment data allows the average driving current(s) to be determined that will be needed in each of the blue LEDs 320*a*, green LEDs 320*b*, the red LEDs 320*c* to result in the desired color at the desired brightness level.

Figure 4B:
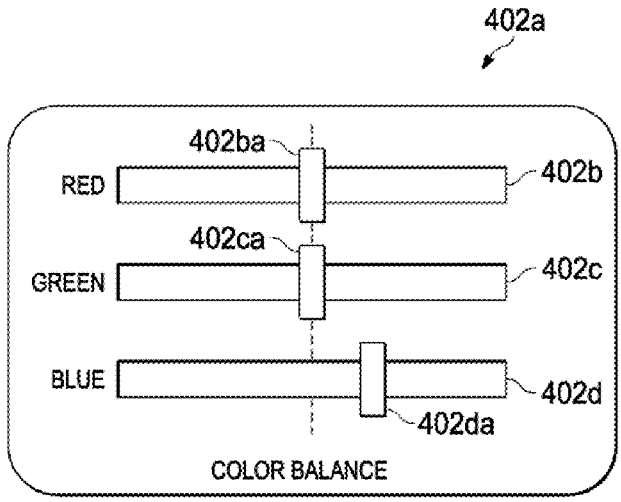
FIG. 4*b* is a schematic view illustrating an embodiment of a user interface for controlling the color of a display.
Figure 4A:
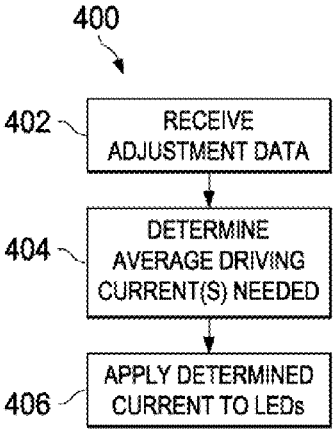
FIG. 4*a* is a flow chart illustrating an embodiment of a method for controlling the color of a display.
Figure 4C:
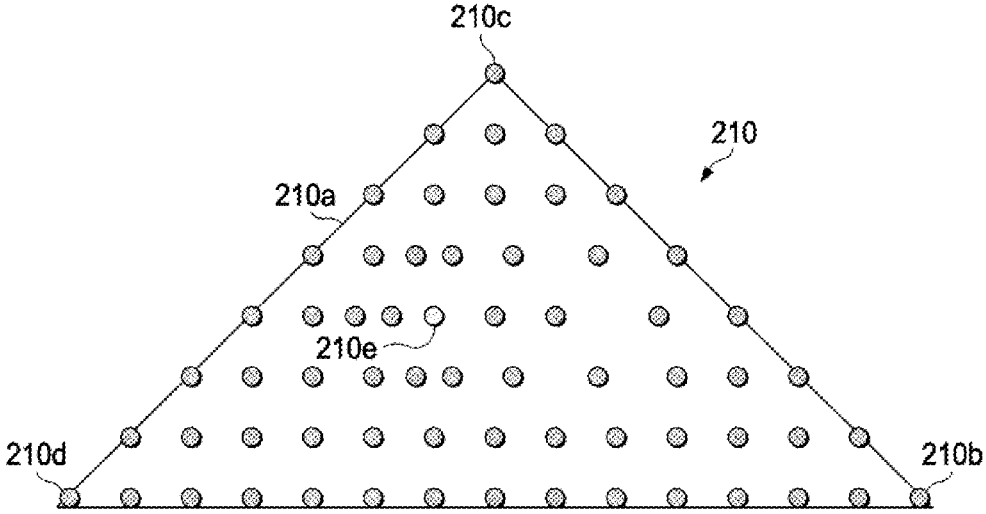
FIG. 4*c* is a schematic view illustrating an embodiment of the shifting of the color pallet points in the color triangle of FIG. 2*c* according to the method of FIG. 4*a*.

In response to writing the adjustment data to the SMBus color offset registers 318*a* and determining the average driving current(s), the driver voltage regulator control unit 330 may send a signal to the blue DC/DC regulator 324, the green DC/DC regulator 326, and/or the red DC/DC regulator 328 to adjust the average driving current to the RGB LEDs 320. By adjusting the average driving current to the blue LEDs 320*a*, the green LEDs 320*b* and/or the red LEDs 320*c*, the intensity of the blue LEDs 320*a*, green LEDs 320*b* and/or red LEDs 320*c* is adjusted, and in turn the color of the backlight provided by the RGB LEDs 320 is adjusted. By adjusting the color of the backlight provided by the RGB LEDs 320, the white point of the display is shifted along with the other fundamental color pallet points on the color triangle 210*a*, which allows the desired color chosen by the user of the IHS 100 to be achieved without losing any of the color pallet points in the color triangle 210*a*. FIG. 4*c* illustrates display color control according to the method 400. With reference back to the color triangle 210*a* of FIG. 2*c* that illustrates the color triangle 210*a* having its initially programmed color points, the color pallet points on the color triangle 210*a* are shifted using the method 400 to achieve the color desired by the user, avoiding the loss of color pallet points in the color triangle 210*a* that occurs with conventional techniques, described with reference to FIG. 2*d*. Thus, a system and method have been described that provide for color control on a display utilizing RGB LED backlighting that allows for true color manipulation without the degradation in overall color performance that occurs using conventional systems and methods.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A Red, Green, Blue Light Emitting Device (RGB LED) backlight color control system, comprising:

an RGB LED backlight comprising a red LED, a green LED, and a blue LED;

a driving current regulator coupled to each of the red LED, the green LED and the blue LED;

a backlight power control coupled to each of the driving current regulators and operable to receive adjustment data and use the adjustment data to adjust the driving current supplied by at least one of the driving current regulators to at least one of the red LED, the green LED and the blue LED;

a storage coupled to the backlight power control, wherein the storage includes a plurality of executable applications that include at least a word processing executable application, each executable application associated with a different set of adjustment data that is stored in the storage, and wherein a set of the word processing executable application adjustment data is operable to be sent from the storage to the backlight power control in response to detecting the execution of the word processing executable application following the execution of one of the other executable applications such that a plurality of color settings are dynamically changed in response to the detected execution of the word processing executable application.

2. The system of claim 1, further comprising:

an interface in the backlight power control that comprises a plurality of color offset registers, wherein the backlight power control is operable to write the adjustment data to at least one of the color offset registers to adjust the driving current supplied by at least one of the driving current regulators to at least one of the red LED, the green LED, and the blue LED.

3. The system of claim 1, wherein the plurality of executable applications include at least a media viewer application, and wherein a set of media viewer executable application adjustment data is operable to be sent from the storage to the backlight power control in response to detecting the execution of the media viewer executable application following the execution of one of the other executable applications such that a plurality of color settings are dynamically changed in response to the detected execution of the media viewer executable application.

4. The system of claim 1, further comprising:

a display panel coupled to the backlight power control, wherein a color sensor is coupled between the display panel and the backlight power control and operable to provide color feedback to the backlight power control for each of the red LED, green LED, and blue LED.

5. The system of claim 1, further comprising:

a user interface coupled to the backlight power control and operable by a user to send the adjustment data to the backlight power control.

6. The system of claim 1, wherein a driver voltage regulator control unit is included in the backlight power control and operable to send a signal to the driving current regulators to adjust the average driving current supplied by at least one of the driving current regulators to at least one of the red LED, the green LED, and the blue LED.

7. The system of claim 1, wherein a color triangle comprising a plurality of color pallet points is associated with a display that uses the RGB LED backlight, and wherein the adjusting of the driving current supplied by at least one of the driving current regulators to at least one of the red LED, the green LED, and the blue LED results in the shifting of the plurality of color pallet points without a loss of any of the color pallet points.

8. The system of claim 1, wherein a driver voltage regulator control unit is included in the backlight power control and operable to send a signal to the driving current regulators to adjust the average driving current supplied by at least one of the driving current regulators to at least one of the red LED, the green LED, and the blue LED.

9. The system of claim 1, wherein a color triangle comprising a plurality of color pallet points is associated with a display that uses the RGB LED backlight, and wherein the adjusting of the driving current supplied by at least one of the driving current regulators to at least one of the red LED, the green LED, and the blue LED results in the shifting of the plurality of color pallet points without a loss of any of the color pallet points.

10. An information handling system, comprising:

a processor;

a display coupled to the processor, the display comprising a RGB LED backlight that includes a red LED, a green LED, and a blue LED;

a driving current regulator coupled to each of the red LED, the green LED, and the blue LED;

a backlight power control coupled to each of the driving current regulators and operable to receive adjustment data and use the adjustment data to adjust the driving current supplied by at least one of the driving current regulators to at least one of the red LED, the green LED, and the blue LED; and a storage coupled to the backlight power control, wherein the storage includes a plurality of executable application type applications that include at least a media viewer executable application type application, each executable application type application associated with a different set of adjustment data that is stored in the storage, and wherein a set of media viewer executable application type application adjustment data is operable to be sent from the storage to the backlight power control in response to detecting the execution of the media viewer executable application type application following the execution of one of the other executable application type applications such that a plurality of color settings for the display are dynamically changed in response to the detected execution of the media viewer executable application type application.

11. The system of claim 10, further comprising:

an interface in the backlight power control that comprises a plurality of color offset registers, wherein the backlight power control is operable to write the adjustment data to at least one of the color offset registers to adjust the driving current supplied by at least one of the driving current regulators to at least one of the red LED, the green LED, and the blue LED.

12. The system of claim 10, wherein the plurality of executable application type applications include at least a word processing executable application type application, and wherein a set of the word processing executable application type application adjustment data is operable to be sent from the storage to the backlight power control in response to detecting the execution of the word processing executable application type application following the execution of one of the other executable application type applications such that a plurality of color settings are dynamically changed in response to the detected execution of the word processing executable application type application.

13. The system of claim 10, further comprising:

a display panel coupled to the display, wherein a color sensor is coupled between the display panel and the backlight power control and operable to provide color feedback to the backlight power control for each of the red LED, green LED, and blue LED.

14. The system of claim 10, further comprising:

a user interface coupled to the backlight power control and operable by a user to send the adjustment data to the backlight power control.

15. A method for controlling the color of a display that uses a Red, Green Blue Light Emitting Device (RGB LED) backlight, comprising:

providing a display comprising an RGB LED backlight that includes a red LED, a green LED, and a blue LED;

receiving an instruction to execute a word processing executable type application;

retrieving word processing executable type application adjustment data that is associated with the word processing executable type application;

determining at least one first drive current using the word processing executable type application adjustment data;

applying the at least one first drive current to at least one of the red LED, the green LED, and the blue LED to adjust a color provided by the RGB LED backlight;

receiving an instruction to execute a media viewer application executable type application;

retrieving media viewer application executable type application adjustment data that is associated with the media viewer application executable type application;

determining at least one second drive current using the media viewer application executable type application adjustment data; and dynamically changing a plurality of color settings for the display by switching from the at least one first drive current to at least one second drive current and applying that at least one second drive current to at least one of the red LED, the green LED, and the blue LED to adjust a color provided by the RGB LED backlight.

16. The method of claim 15, wherein the determining at least one first drive current using the word processing executable type application adjustment data and the determining the at least one second drive current using the media viewer application executable type application adjustment data comprises writing the word processing executable type application adjustment data and the media viewer application executable type application adjustment data to a color offset register.

* * * * *